US010676276B2

(12) United States Patent
Bush

(10) Patent No.: US 10,676,276 B2
(45) Date of Patent: Jun. 9, 2020

(54) METHOD AND APPARATUS FOR RAISING A FLOATING ROOF DISPOSED IN A STORAGE TANK

(71) Applicant: David L. Bush, Upland, CA (US)

(72) Inventor: David L. Bush, Upland, CA (US)

(73) Assignee: Delta P Technology International, LLC, Picayune, MS (US)

( * ) Notice: Subject to any disclaimer, the term of this patent is extended or adjusted under 35 U.S.C. 154(b) by 386 days.

(21) Appl. No.: 15/170,887

(22) Filed: Jun. 1, 2016

(65) Prior Publication Data

US 2017/0355519 A1 Dec. 14, 2017

Related U.S. Application Data

(63) Continuation-in-part of application No. 15/003,714, filed on Jan. 21, 2016, now Pat. No. 10,112,770.

(51) Int. Cl.

| | |
|---|---|
| ***H02G 1/00*** | (2006.01) |
| ***B65D 90/66*** | (2006.01) |
| ***B65D 88/40*** | (2006.01) |
| ***B65D 88/34*** | (2006.01) |
| ***B65D 90/48*** | (2006.01) |

(52) U.S. Cl.

CPC ..... *B65D 90/66* (2013.01); *B65D 88/34* (2013.01); *B65D 88/40* (2013.01); *B65D 90/48* (2013.01)

(58) Field of Classification Search

CPC ..... B66F 3/04; B66F 3/28; B66F 2700/05

See application file for complete search history.

(56) References Cited

U.S. PATENT DOCUMENTS

| | | | | |
|---|---|---|---|---|
| 1,989,624 | A | 1/1935 | Matter | |
| 2,847,755 | A | 8/1958 | Mummert et al. | |
| 4,497,597 | A | 2/1985 | Chlumecky | |
| 4,630,550 | A | 12/1986 | Weitzman | |
| 4,807,851 | A | 2/1989 | De Castro | |
| 5,230,197 | A | 7/1993 | Hart | |
| 5,255,698 | A * | 10/1993 | Riley | E04H 15/34 135/142 |
| 5,430,989 | A | 7/1995 | Jones | |
| 5,611,187 | A | 3/1997 | Jones | |
| 6,321,503 | B1 | 11/2001 | Warren | |

(Continued)

FOREIGN PATENT DOCUMENTS

GB 489822 A 8/1938

OTHER PUBLICATIONS

International Search Report dated Aug. 10, 2017 for International Application PCT/US2017/033571.

(Continued)

*Primary Examiner* — Lee D Wilson
(74) *Attorney, Agent, or Firm* — Holland & Hart, LLP

(57) ABSTRACT

Method and apparatus for raising a floating roof included in a storage tank whereby a first and a first opposite force are applied between a floor in the storage tank and an internal surface of the floating roof. An additional set of forces are also provided and are constrained according to the first and first opposite force, not only in magnitude, but in position. By constraining these forces to be applied orthogonally to the floating roof, horizontal shear forces can be resisted thus reducing the likelihood of failure of a cribbing unit. By increasing these forces, the roof is raised.

20 Claims, 14 Drawing Sheets

(56) References Cited

U.S. PATENT DOCUMENTS

| | | | | |
|---|---|---|---|---|
| 6,675,820 | B2 | 1/2004 | Balan | |
| 6,687,930 | B1 * | 2/2004 | Eads | A47C 29/003 135/121 |
| 6,766,623 | B1 * | 7/2004 | Kalnay | E04B 1/34305 135/128 |
| 10,112,770 | B2 | 10/2018 | Bush | |
| 2005/0022465 | A1 | 2/2005 | Warren et al. | |
| 2009/0025265 | A1 | 1/2009 | Jedlicka | |
| 2009/0321447 | A1 | 12/2009 | Imhof | |
| 2012/0180283 | A1 | 7/2012 | Erdmann et al. | |
| 2016/0137405 | A1 | 5/2016 | Bush | |
| 2016/0332810 | A1 | 11/2016 | Blinn et al. | |
| 2017/0355519 | A1 * | 12/2017 | Bush | B65D 88/34 |

OTHER PUBLICATIONS

Final Office Action dated Jan. 12, 2018 in connection with U.S. Appl. No. 15/003,714.
Information about Related Patents, Patent Applications, and Patent Office Proceedings see the section below having the same title.
Information Submitted in Parent Patent Applications, see MPEP 609.02 and the section below having the same title.
U.S. Appl. No. 15/003,714, filed Jan. 21, 2016, Bush, Method and Apparatus for Supporting a Floating Roof Disposed in a Storage Tank.

* cited by examiner

PRIOR ART

METHOD AND APPARATUS FOR RAISING A FLOATING ROOF DISPOSED IN A STORAGE TANK

RELATED APPLICATIONS

This application is a continuation-in-part of U.S. patent application Ser. No. 15/003,714, titled "Method and Apparatus for Supporting a Floating Roof Disposed in a Storage Tank," by David L. Bush, filed on Jan. 21, 2016, the specification and figures of which are incorporated herein by reference in their entirety and the priority date of which is claimed herein to the maximum extent allowable.

BACKGROUND

There are many situations where there is a need to support a planar structure at variable distances in height above the ground. One such application is that of a storage tank that includes a floating roof disposed therein. This example use case can be best described with reference to FIG. 1. In FIG. 1, a floating roof structure 107 is typically used where a storage tank 205 is used to store a liquid, for example, jet fuel, gasoline, diesel, sour water and crude oil. It should be appreciated that these are merely examples of the type of liquids that can be stored in a tank.

It is common place for such a storage tank to include a floating roof structure for environmental protection purposes. Floating roofs substantially reduce the emission of flammable and/or hazardous vapor to the environment. It should be appreciated that such a floating roof structure "floats" on top of the liquid product stored in the storage tank. As the level of the liquid product stored in the tank fluctuates, so does the height of the floating roof structure relative to a floor included in such a tank.

Government regulations mandate that such storage tanks be inspected every ten years. Such an inspection is generally required to meet the requirements of API 653. The regulations require that all above ground storage tanks are to be inspected and repaired to API 653 standards in order to verify the structural integrity of the tank shell, the integrity of the floating roof vapor control, and the tank floor. One aim of such inspections is to detect and remedy any seepage of hazardous, toxic or flammable liquids into the ground.

Undetected seepage is likely to cause environmental impact with wide reaching consequences, such as pollution of water tables. For example, more frequent inspection could have prevented a recent environmental crisis in West Virginia where a hazardous chemical leaked from a storage tank and contaminated the water table. Because such inspections are known to reveal the type and extent of repairs needed to remedy leaks and other environmental cataclysms, it is unlikely that any of these inspection requirements will ever be abated. There are also occasions when the storage tank must be cleaned in preparation for storing a different liquid product or a different class of a liquid product relative to a former substance previously stored in the tank. The floating roof must be held above the floor of the storage tank so that personnel can freely and safely conduct themselves during all such inspection, repair and cleaning activities.

FIG. 1 is a pictorial representation of a prior art apparatus for supporting a floating roof when a storage tank is devoid of liquid content. For years and years and years, the process of supporting a floating roof in the absence of a liquid product has been accomplished using substantially similar methods, each of which rely on the use of substantially identical support apparatus. As can be seen, the prior art has thus far relied on a basic support method using a "cribbing stack," also known as a "vertical load backup."

A cribbing stack 103 is typically made up of alternating layers of wood members, wherein each wood member from a preceding layer is set orthogonal to a subsequent layer. Hence, the height of the cribbing stack could be adjusted by simply stacking up more of such alternating layers of wooden members. Up until now, this prior art technique has been used without much deviation from this basic concept, that being the use of alternating layers of wooden members. It should be noted that these wooden members are somewhat akin to common railroad ties that are readily available throughout the world.

FIG. 1 also depicts one grave disadvantage associated with the use of a wooden, layered cribbing stack. It is well settled that a floating roof may exhibit rotational forces 109. When the floating roof is first lowered and substantially all product is removed from the tank, a collection of "legs," each of which penetrates the floating roof, are used to support the floating roof. These legs are very susceptible to horizontal forces that each leg experiences when the roof begins to rotate. This is true regardless of whether the storage tank is empty or of it has liquid content.

Wind can induce such rotational movement of the floating roof. There are methods to retard such rotational movement, but these methods often fail. One such method is based on the use of "anti-rotation wedges." These wedges are, by their very name, disposed between an outer perimeter of the floating roof and an internal wall of the storage tank. Such anti-rotational wedges are scarcely effective in the face of severe rotational movement of the floating roof.

It is when the floating roof exhibits rotational movement that personnel working under the floating roof situated in a storage tank are most vulnerable to injury and death. When a floating roof begins to rotate, it begins to apply a moment force on each leg. As the legs begin to fail, the plurality of wooden cribbing stacks are intended to support the floating roof at some minimum height necessary to keep all personnel safe. Because the layers of a wooden cribbing stack are not fastened to each other, the cribbing stack simply falls apart when these horizontal forces go unopposed. The upper layers of the cribbing stack, from a force perspective, simply shear away from the lower layers of the cribbing stack. This, of course, results in the type of total failure of the support structure that has cost many lives and has resulted in extensive collateral, material damage and environmental impact.

There are many serious environmental issues associated with the use of a wooden cribbing stack. It should be appreciated that the product ordinarily stored in a storage tank is a liquid and such liquids are typically hazardous materials. Such hazardous material may include petro chemical products, crude oil, flammable liquids and many other forms of extremely hazardous materials. Residual product in the storage tank will ordinarily permeate the wooden members. Hence, such contaminated wooden members cannot be reused and must be discarded as hazardous waste. Each time a wooden member is discarded, new lumber must be used at the cost of many trees, harvested from our forests, further impacting global warming and greenhouse gas effects.

DRAWINGS

Several alternative embodiments will hereinafter be described in conjunction with the appended drawings and figures, wherein like numerals denote like elements, and in which.

DETAILED DESCRIPTION

Figure 1:
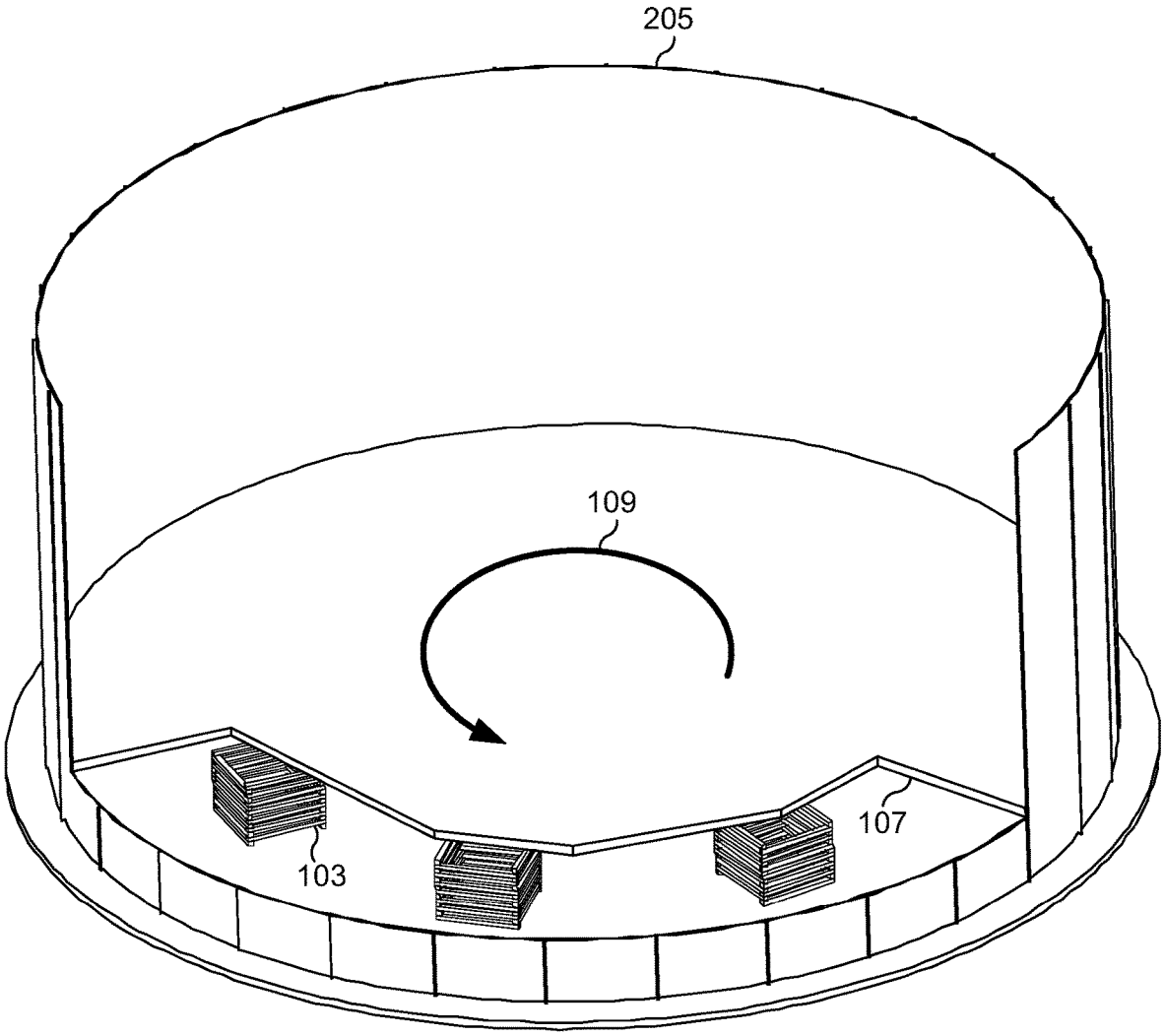
FIG. 1 is a pictorial representation of a prior art apparatus for supporting a floating roof when a storage tank is devoid of liquid content.
Figure 2:
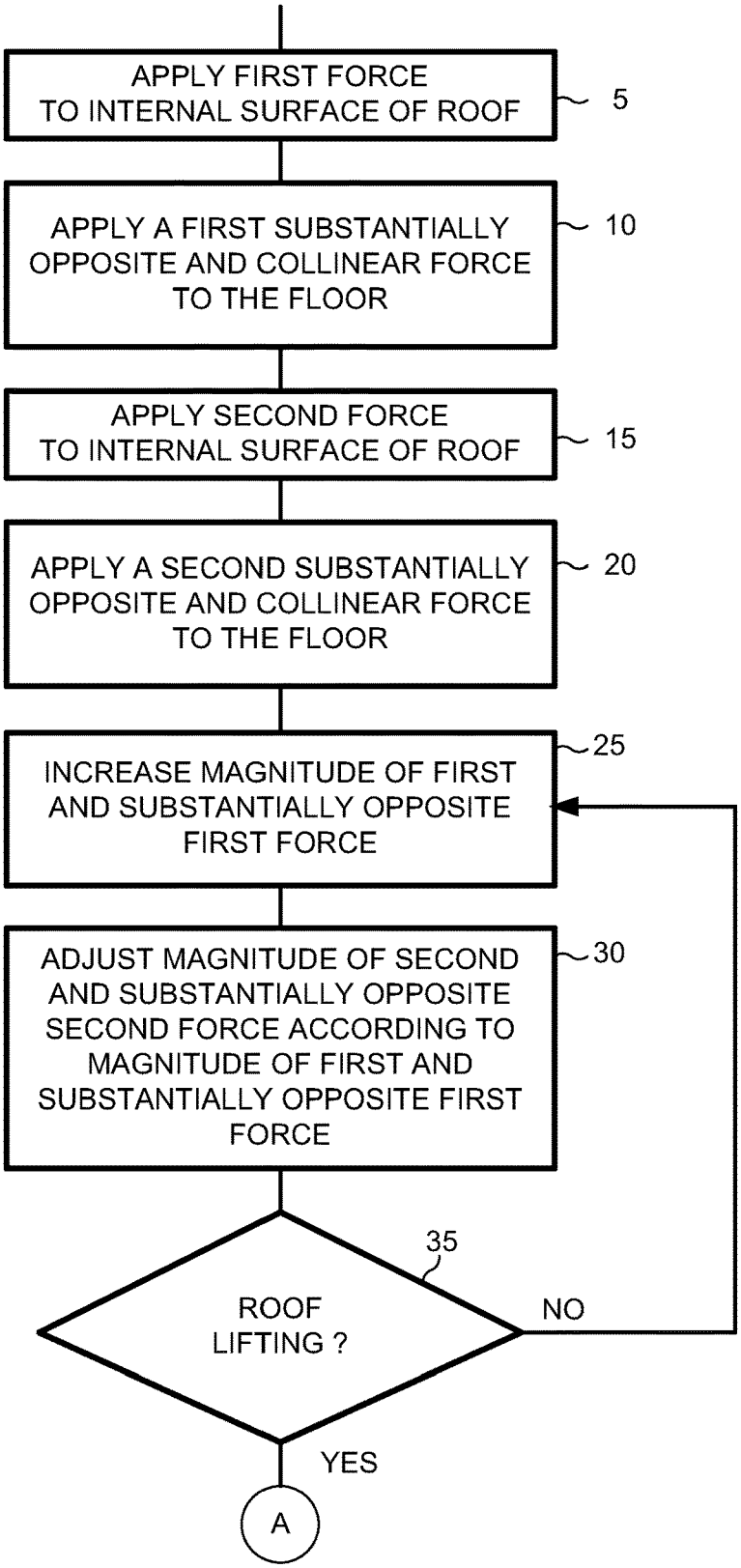
FIG. 2 is a flow diagram that depicts one example method for raising a first section of floating roof.

FIG. 2 is a flow diagram that depicts one example method of raising a first section of floating roof. It should be appreciated that a storage tank, as already described in applicant's first disclosure referenced and incorporated herein, typically includes a floating roof. There are occasions where the floating roof may rotate and collapse and this can result in injury and death to personnel working under such roofs. According to one example method, raising a floating roof is accomplished by applying a first force to an internal surface of the roof (step 5). It should be appreciated that any reference to a method step by a reference to a figure, e.g. "(step 1)," is intended to include that method step in an open-ended enumeration of steps as provided in the method claims appended hereto.

According to this example method, a first substantially opposite linear force is applied to the floor (step 10). Much akin to a method for supporting a floating roof described in the referenced application, the first force and the first opposite force are typically provided by a vertically disposed mechanical member. In this example method, the vertically disposed mechanical member can be extended in order to effect raising of the floating roof. In contrast with the disclosure of a method for supporting a floating roof referenced herein, a method for supporting a floating roof does not provide for extension of such a vertically disposed mechanical member.

This example method continues by applying a second force to the internal surface of the roof (step 15). A second substantially opposite and linear force to that (to the second force) is applied to the floor (step 20). In order to effect raising of the floating roof, the magnitude of the first substantially opposite first force is increased (step 25). It should also be appreciated that the magnitude of the second substantially opposite second force is adjusted according to the magnitude of the first substantially opposite first force (step 30). These magnitudes are increased until the roof begins to lift (step 35).

It should be appreciated that, according to various alternative example methods, the magnitude of the second substantially opposite second force is adjusted so that the force applied to a first section of a floating roof is substantially uniform, when considering that the first and first opposite force and the second and second opposite force are used conjunctively in raising such first portion of a floating roof.

Figure 3:
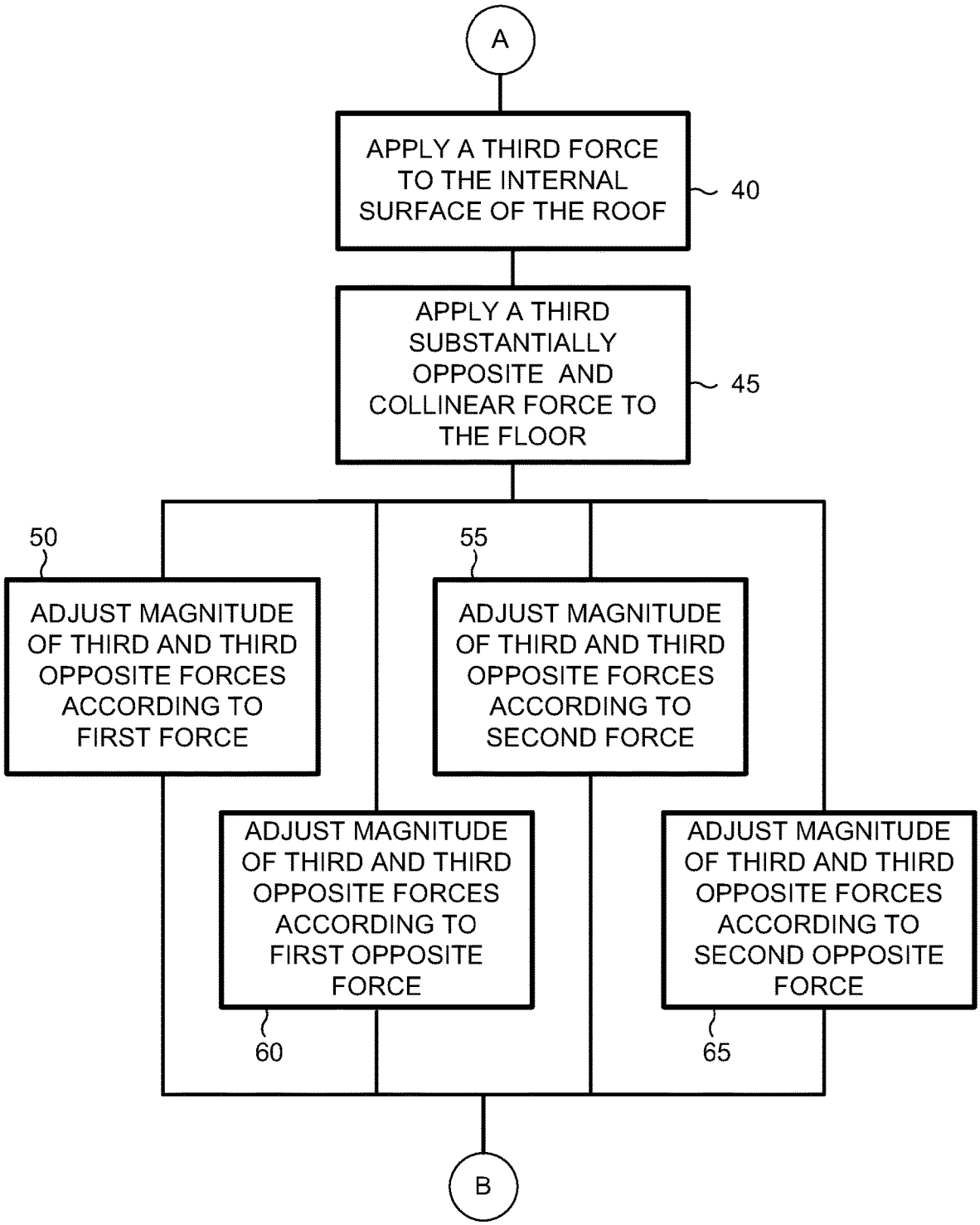
FIG. 3 is a flow diagram that depicts one alternative example method for raising a first section of floating roof which relies upon a third set of forces.

FIG. 3 is a flow diagram that depicts one alternative example method for raising a first section of floating roof which relies upon a third set of forces. In this alternative example method, a third force is applied to the internal surface of the roof (step 40). A third substantially opposite and linear force is applied to the floor (step 45). It should be appreciated that, according to the various alternative methods herein disclosed, a first force and a first substantially opposite and linear force are typically applied contemporaneously and are typically applied by a single vertical member that contacts the floor at one end and the floating roof at the other end.

In this alternative example method, the magnitude of the third force and the substantially opposite linear force is adjusted according to at least one of the magnitude of the first force (step 50), the magnitude of the first opposite force (step 60), the magnitude of the second force (step 55), and the magnitude of the second opposite force (step 65).

It should be appreciated that any of the forces applied to either the internal surface of the floating roof or to the floor may be used as references in order to adjust the third force and its substantially equal and linear force. In this manner, the force applied to raise the floating roof is essentially uniform across a particular first section of a floating roof.

Figure 4:
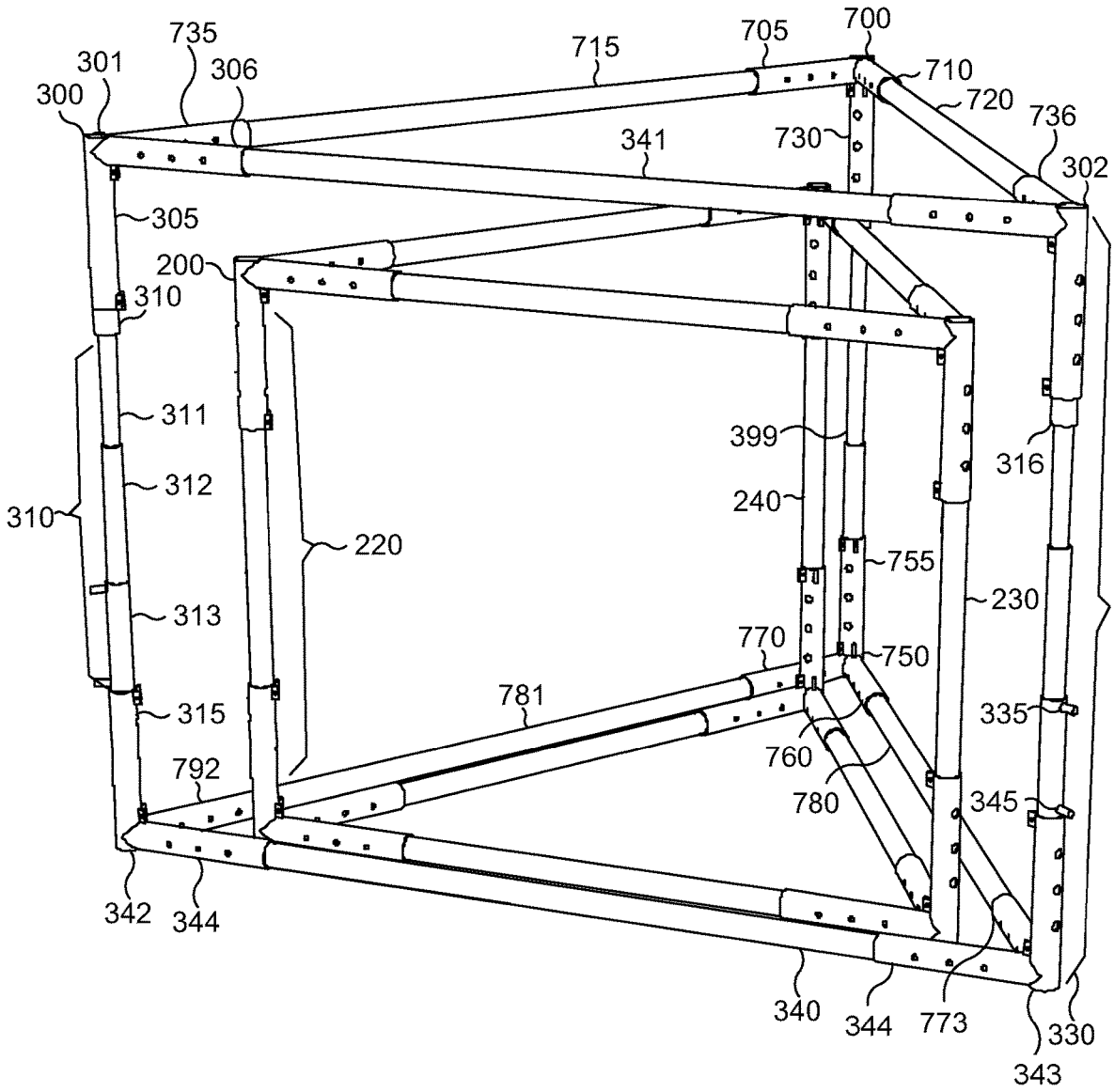
FIG. 4 is a pictorial diagram that illustrates the usage of a Delta-P lifting unit together with a Delta-P cribbing unit.

FIG. 4 is pictorial diagram that illustrates the usage of a Delta-P lifting unit 300 together with a Delta-P cribbing unit 200. It should be appreciated that, according to various alternative use cases, a Delta-P lifting unit 300 is used to raise a floating roof. However, to provide added safety for personnel, a Delta-P cribbing unit 200 may be used to reduce the risk of a catastrophic collapse of a floating roof as it is being lifted according to the teachings of the present method. In such situations, it should be appreciated that a Delta-P cribbing unit 200 includes vertical support members 220, 230, 240, which are substantially disposed at the points of a triangle when viewed from a plan perspective. This alternative embodiment of a cribbing unit is described in the incorporated reference. It should further be appreciated that one alternative method relies upon placement of the extendable vertical support members 330 included in a Delta-P lifting unit 300 proximate to the vertical support members 220, 230, 240 included in a Delta-P cribbing unit 200.

In a manner of speaking, a Delta-P cribbing unit 200, according to one example method, is placed coaxially with a Delta-P lifting unit 300. Although FIG. 4 depicts that a cribbing unit 200 is smaller than a lifting unit 300, this is only one example of how a Delta-P lifting unit 300 can be used with a Delta-P cribbing unit 200. It should be appreciated that a converse arrangement may be utilized where the Delta-P cribbing unit 200 is larger than the lifting unit 300.

What should be appreciated from this discussion is that vertical members 330 in the Delta-P lifting unit 300 are, according to one alternative method, positioned proximate to vertical members 220, 230, 240 included in the Delta-P cribbing unit 200. Again, this is merely one illustrative use case which applicant believes is an effective means for using a cribbing unit 200 as a precautionary means for preventing a catastrophic collapse of a floating roof during a lifting procedure, as taught by the various alternative methods disclosed herein and by the cribbing techniques and methods taught in the incorporated reference.

Figure 5:
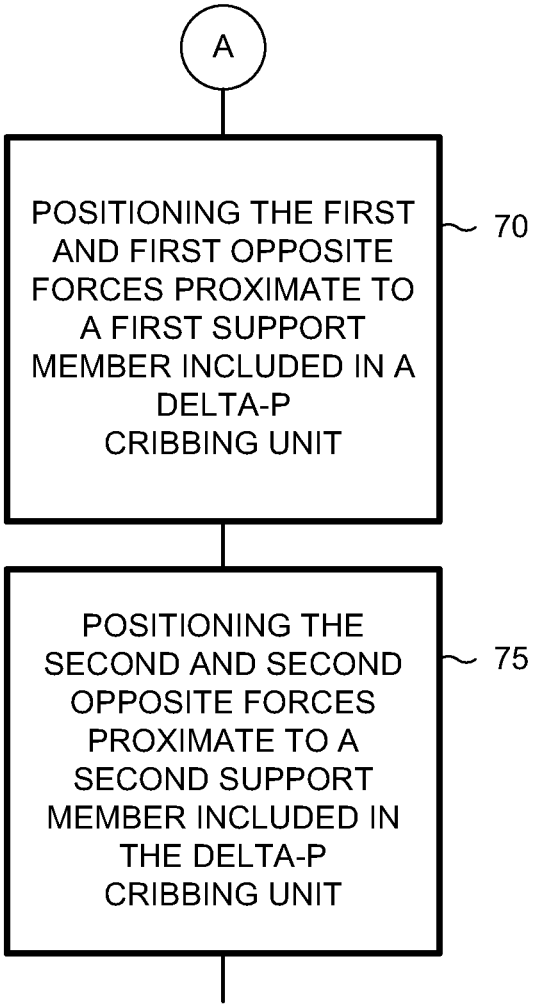
FIG. 5 is a flow diagram that depicts one alternative example method wherein raising a roof is accomplished with additional confidence through the use of a cribbing unit.

FIG. 5 is a flow diagram that depicts one alternative example method wherein raising a roof is accomplished with additional confidence through the use of a cribbing unit. As already discussed in relationship to FIG. 4, a Delta-P lifting unit 300, according to one alternative method, is used in conjunction with a Delta-P cribbing unit 200. Accordingly, in this alternative example method, the first and first opposite forces are positioned proximate to a first support member included in a Delta-P cribbing unit 200 (step 70). Likewise, the second and second opposite force are positioned proximate to a second support member included in the Delta-P cribbing unit 200 (step 75).

Figure 6:
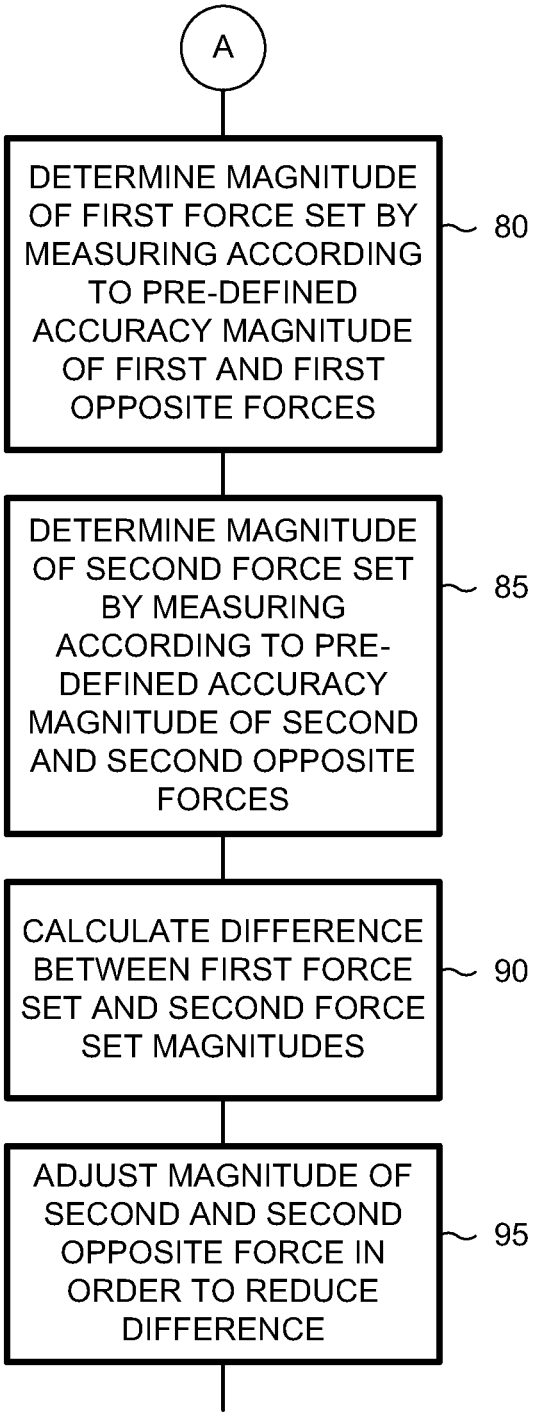
FIG. 6 is a flow diagram that depicts one example method for adjusting the magnitude of the second and second opposite forces.

FIG. 6 is a flow diagram that depicts one example method for adjusting the magnitude of the second and second opposite forces. It should be appreciated that the first force and a first opposite force, which is substantially collinear with and substantially equal in magnitude to the first force, may be referred to as a force set. Accordingly, the magnitude of a first force set, which in this disclosure includes the first force and its substantially opposite and collinear first force, is used as a reference for adjusting the second force set, which according to this disclosure includes the second and its substantially opposite and collinear second force.

In this alternative example method, a first method step comprises determining the magnitude of the first force set by measuring, according to a pre-defined accuracy, the magnitude of the first and the first opposite and substantially collinear force (step 80). Next, the magnitude of the second force set is determined by measuring, according to a pre-defined accuracy, the magnitude of the second and its substantially opposite and collinear second force (step 85). Once the magnitudes of the first and second forces sets are determined, a difference in these magnitudes is then calculated (step 90). The magnitude of the second and second opposite forces is then adjusted in order to reduce the difference between the first and second force sets (step 95).

Figure 7:
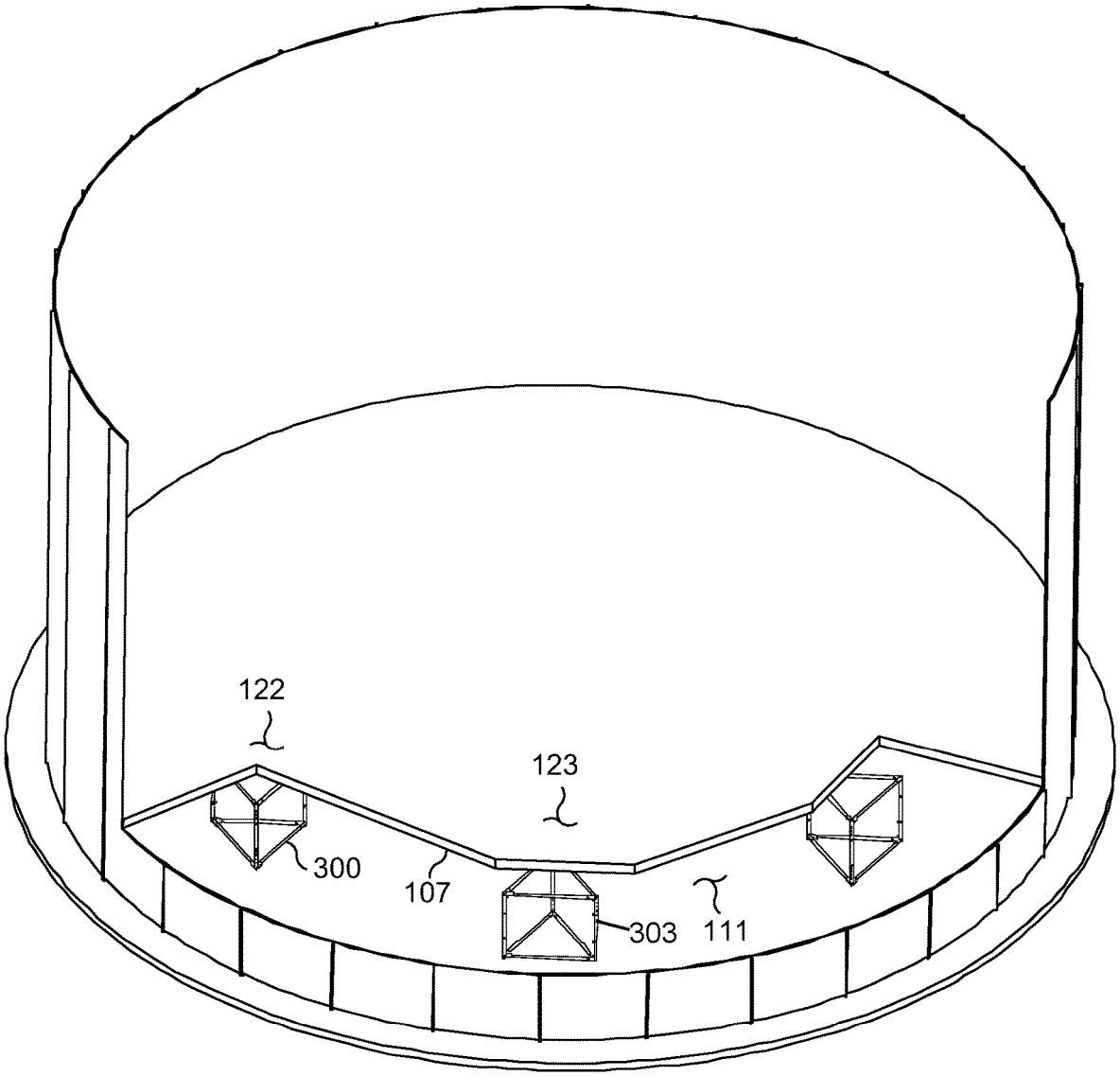
FIG. 7 is a pictorial diagram that depicts the application of forces in order to raise different portions, or sections of a floating roof.

FIG. 7 is a pictorial diagram that depicts the application of forces in order to raise different portions, or sections of a floating roof. In this figure, a floating roof 107 is being raised in at least two different portions of the roof. In this illustrative use case, a set of forces is applied to a first section of a floating roof 122. This is typically accomplished by a first Delta-P lifting unit 300.

A second Delta-P lifting unit 303 is utilized in order to apply lifting forces to a second section 123 of the floating roof 107. Although not seen in this figure, the floating roof 107 includes an internal surface, upon which forces are applied to raise the roof 107. A storage tank itself includes a floor 111, upon which are applied substantially equal forces that are collinear to the forces applied to the internal surface of the roof.

Figure 8:
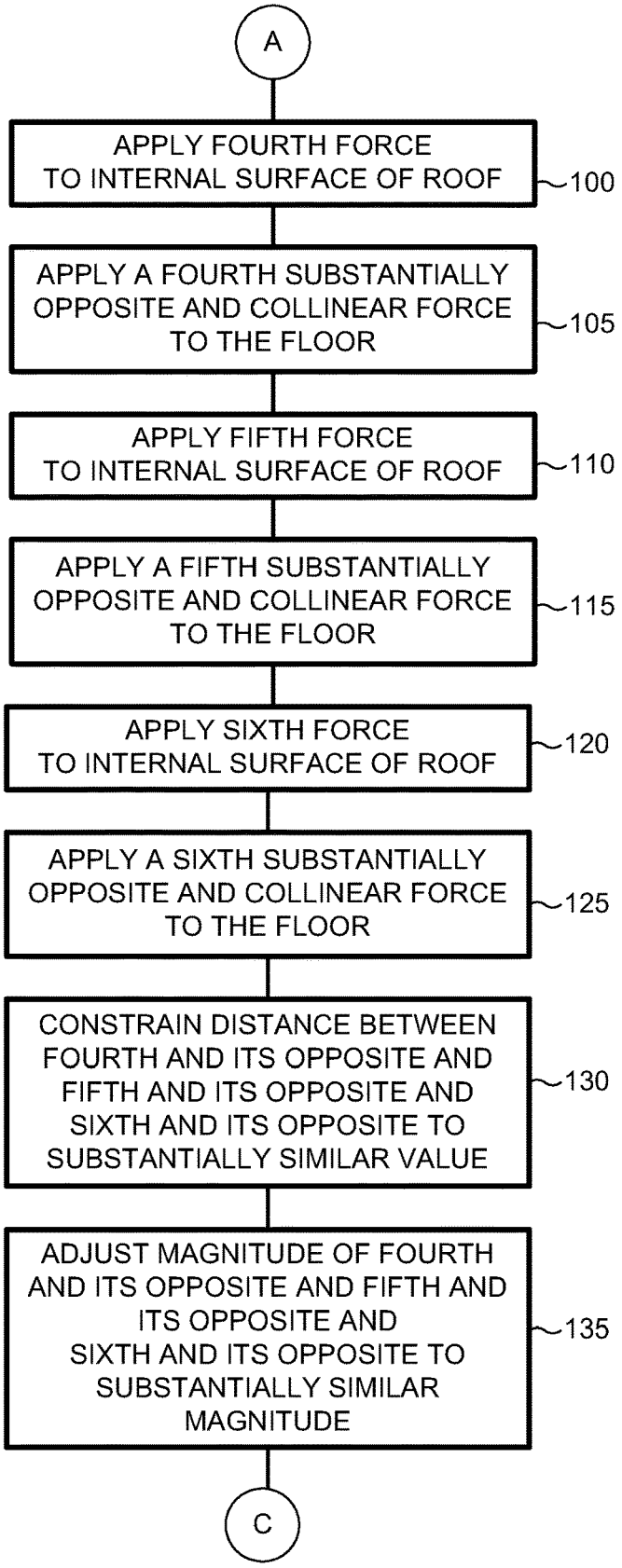
FIG. 8 is a flow diagram for one alternative example method for lifting a second portion of a floating roof.

FIG. 8 is a flow diagram for one alternative example method for lifting a second portion of a floating roof. According to this alternative example method, a second portion of the floating roof is lifted by applying a fourth force to the internal surface of the floating roof (step 100) along with a fourth substantially opposite and substantially collinear force to the floor of the storage tank (step 105). In essentially a contemporaneous manner, a fifth force is applied to the internal surface of the roof (step 110) along with application to the floor of a fifth substantially opposite and substantially collinear force (step 115). In this example alternative method, a sixth force is applied to the internal surface of the roof (step 120) and a sixth substantially opposite and substantially collinear force is applied to the floor (step 125).

It should be appreciated that according to this alternative example method, lifting a second portion of a floating roof is typically accomplished by a Delta-P lifting unit as already discussed relative to FIG. 7. Accordingly, an additional step includes constraining the distance between the fourth and its opposite force, the fifth and its opposite force, and a sixth and its opposite force to a substantially similar value (step 130).

It should be appreciated that this step of constraining the distances to a substantially equal value should typically result in a triangular pattern commensurate with Delta-P lifting technology disclosed herein. Applying these forces provides for lifting a second portion of a roof, but does not provide for a uniform application of force in said second portion of the roof. Accordingly, it is typically necessary to adjust the magnitude of the fourth and its opposite force and the fifth and its opposite force and a sixth and its opposite force so all of these forces are at a substantially similar magnitude (step 135).

Figure 9:
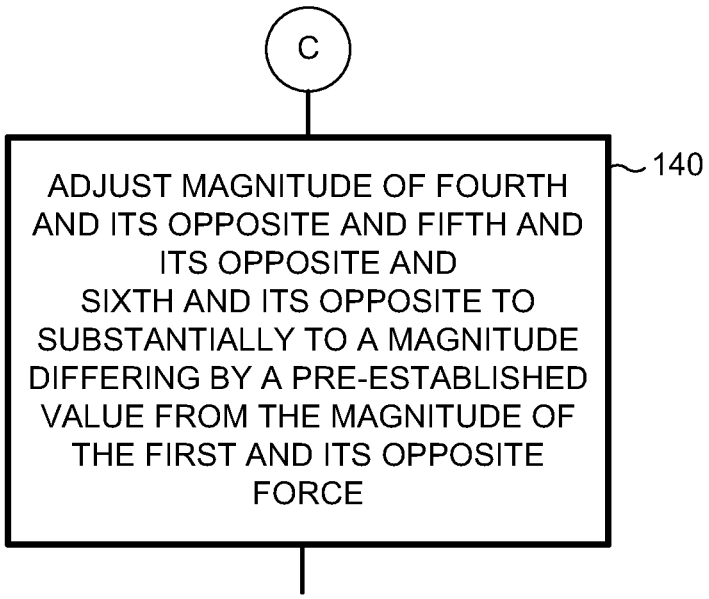
FIG. 9 is a flow diagram that depicts an alternative example method wherein a second portion of a roof is lifted by a force substantially similar to the forces applied in lifting a first section of a floating roof.

FIG. 9 is a flow diagram that depicts alternative example method wherein a second portion of a roof is lifted by a force substantially similar to the forces applied in lifting a first section of a floating roof. Just as the forces within a particular section of roof should be maintained at a substantially similar magnitude, as already described, one alternative example method provides for maintaining a substantially similar force across two or more sections of roof that are being lifted in accordance with the teachings presented herein. Accordingly, one such alternative example method provides for adjusting the magnitude of the fourth and its opposite force, the fifth and its opposite force, and a sixth and its opposite force so as the magnitude of these forces is substantially similar to the first and first opposite forces applied in a first section of the roof.

In yet another alternative example employment, the forces in a second portion of the roof are adjusted so that their magnitude differs from forces applied in a first section of the roof by a pre-established value. This example alternative method recognizes that the force applied to a first section of the roof may need to be different than forces applied to a second section of the roof because of the mechanical dynamics involved in raising the roof. For example, once a particular section of roof is raised to a particular level the total force at a particular section may be greater or less than the forces involved in supporting and ultimately raising a second portion of the roof.

FIG. 4 further illustrates one example embodiment of a lifting system that is useful in applying the methods taught herein. According to this one example employment, a lifting system 300 comprises a first base member 342 and a second base member 343. Each such base member 342, 343 includes a vertical riser receptacle or coupler 315 and a receptacle or coupler 344 for a horizontal span. This example embodiment further includes a first cap or capping member 301 and a second cap or capping member 302. It should be appreciated that each of these cap members 301, 302 includes a receptacle or coupler 305 for a vertical riser and a receptacle or coupler 306 for a horizontal cap span. This example embodiment further includes a horizontal base span 340 and a horizontal cap span 341, which, upon assembly, are received by corresponding receptacles 344, 306 included in the base members 342, 343 and the cap members 301, 302.

Referring to the incorporated reference, it should be noted that vertical risers are used in order to hold the base span members and the cap or capping span members at some vertical distance from each other. Typically, the base span members are placed upon a storage tank floor and then the vertical risers are used to hold the cap members, along with the cap span at some elevation above the storage tank floor. Again, it should be appreciated that, according to the incorporated reference and the teachings herein, the vertical risers are received by the vertical riser receptacles included in the cap members and the base members.

According to one example embodiment of a lifting system 300, the vertical risers are not fixed in length as they are in a Delta-P cribbing unit, as described in the incorporated reference. Rather, a lifting system 300 includes a plurality of extendable risers 310. The extendable risers 310 are received by the vertical riser receptacles 305, 315 included in the cap members 301, 302 and the base members 342, 343.

In order to fully appreciate the structure of this example embodiment of the lifting system 300, we draw attention to a first extendable riser 310, included in this example embodiment, which is received by the vertical riser receptacle 315 included in the first base member 342 and is also received in a riser receptacle 305 included in the first the cap member 301. A second extendable riser 316 is also included in this example embodiment and is received by the vertical riser receptacle 315 in the second base member 343 and the riser receptacle 305 included in the second cap member 302.

FIG. 4 further illustrates that an extendable riser includes a length control function, which according to one alternative example embodiment is enabled by application of a working fluid to a first port 345. When a pressurized working fluid is applied to the first port 345, the length of the extendable riser 310, 316 increases according to the pressure of the working fluid. It should be appreciated that, according to one alternative example embodiment, an extendable riser 310, 316 comprises a pressurized cylinder which extends in length when a hydraulic fluid, under pressure, is directed to such a first port 345.

It should likewise be appreciated that, according to yet another alternative example embodiment, the length control function is enabled by application of a working fluid to a second port 335. In this alternative example embodiment, the second port 335 receives pressurized working fluid in order to shorten the length of the extendable riser 310, 316. It should further be appreciated that, according to one alternative example embodiment, an extendable riser 310, 316 that can be shortened in this manner comprises a pressurized cylinder that includes a dual action capability. Such "dual action" pressurized cylinders extend the length of the cylinder upon application of a pressurized working fluid to the first port 345 and shorten the length of the cylinder upon application of a pressurized working fluid to the second port 335.

Figure 10A:
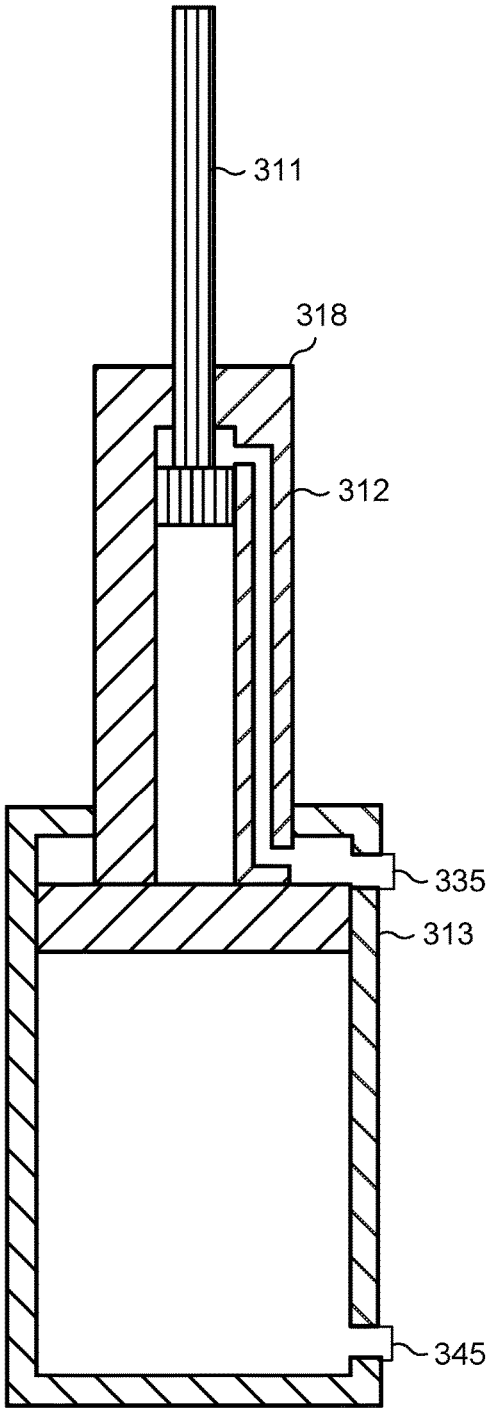
FIGS. 10A and 10B are pictorial diagrams that depict one alternative example embodiment of a multistage, extendable riser.
Figure 10B:
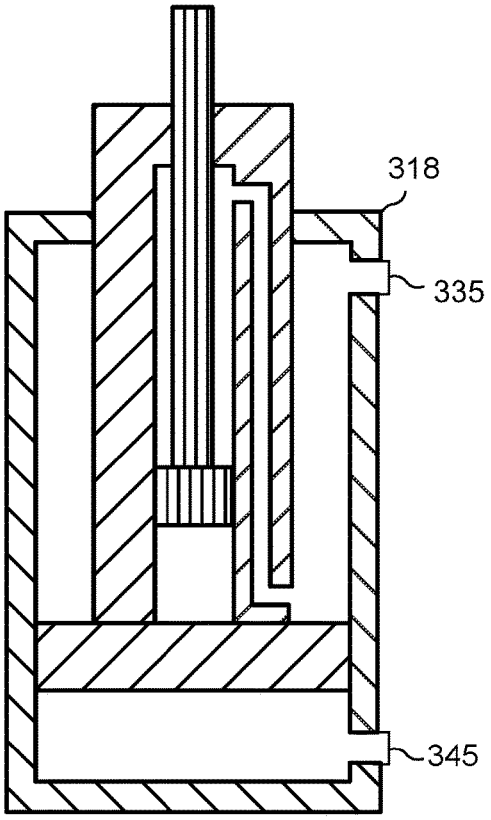

FIGS. 10A and 10B are pictorial diagrams that depict one alternative example embodiment of a multistage, extendable riser. It should be appreciated that, according to one alternative example embodiment, an extendable riser 310, 316 included in a lifting system 300 comprises, a dual acting, multistage pressurized cylinder 318. FIG. 10A illustrates that, according to another alternative example embodiment, an extendable vertical riser comprises a two-stage cylinder 318 that includes a first stage 313, a second stage 312 and a piston 311.

It should be appreciated that multistage, dual acting pressurized cylinders are quite commonplace. The figures here are only intended to illustrate one example embodiment of such pressurized cylinders and there is no need to teach the intricacies of this well-known technology. A very high-level summary reveals that the first stage 313 of the cylinder 318 acts upon the second stage 312 of the cylinder 318.

It should be appreciated that the second stage 312 of the cylinder 318 acts as a piston within the first stage 313 of the pressurized cylinder. Since the second stage 312 of the cylinder 318 acts as a piston relative to the first stage 313, application of a pressurized fluid at the first port 345 causes the second stage 312 to push upward away from the first port 345.

The pressurized working fluid is also channeled into the second stage 312 (not shown) in order to cause the piston 311 to move upward away from the first port 345. Additional channeling is provided for the second port 335 in order to cause retraction of the piston 311 into the second stage 312 and retraction of the second stage 312 into the first stage 313 as shown in FIG. 10B. Such a two stage cylinder 318 is also depicted in FIG. 4 where like reference numerals correspond to like stages and the piston 311 that the second stage 312 acts upon.

FIG. 4 further illustrates that, according to yet another alternative example embodiment, the first and second base members 342, 343 further include second base span receptacles 792, 773. Further, this alternative example embodiment includes cap members 301, 302 that include a second cap or capping span receptacle 735, 736. This alternative example embodiment provides for and includes a third extendable riser 399. This alternative example embodiment also includes a third base member 750, and a third cap or capping member 700. It should be appreciated that the third base member 750 and the third cap member 700 include two base span receptacles 760, 770 and two cap span receptacles 705, 710, respectively.

It should be appreciated that, according to this alternative example embodiment, a lifting system comprises a Delta-P lifting unit 300. It should be further appreciated that, according to one alternative example embodiment, the three extendable risers 310, 316, 399, when viewed from the top of the lifting unit 300, are situated at the vertices of a substantially equilateral triangle. As such, the base span receptacles, for example the base span receptacles 344 and 792 included in the first base member 342, are set at an angle substantially equal to 60 degrees. This is true for all of the receptacles, except for the vertical riser receptacles, included in any particular base member or cap member. It should likewise be appreciated that the vertical riser receptacles are situated substantially orthogonal to the base span and cap span receptacles.

Assembly of such a Delta-P lifting unit 300 is accomplished by receiving an included second base span 781 into the first base span receptacle 770 included in the third base member 750. This second base span 781 is also received in the second base span receptacle 792 of the first base member 342. A third base span 780 is also included in this alternative example embodiment and is received in the second base span receptacle 760 of the third base member 750. The other end of the third base span 780 is received by the second base span receptacle 773 included in the second base member 343.

This alternative embodiment also includes a second cap span 715 and a third cap span 720. The second cap span 715 is received in the first cap span receptacle 705 in the third cap member 700. This second cap span 715 is also received in the second cap span receptacle 735 included in the first cap member 301. The third cap span 720 is received into the second cap span receptacle 710 included in the third cap member 700. The second cap span receptacle 736 included in the second cap member 302 receives the other end of the third cap span 720. Assembly of this alternative example embodiment also provides that the third extendable riser 399 is received in the vertical riser receptacle 730 included in the third cap member 700 and the vertical riser receptacle 755 included in the third base member 750.

Figure 11:
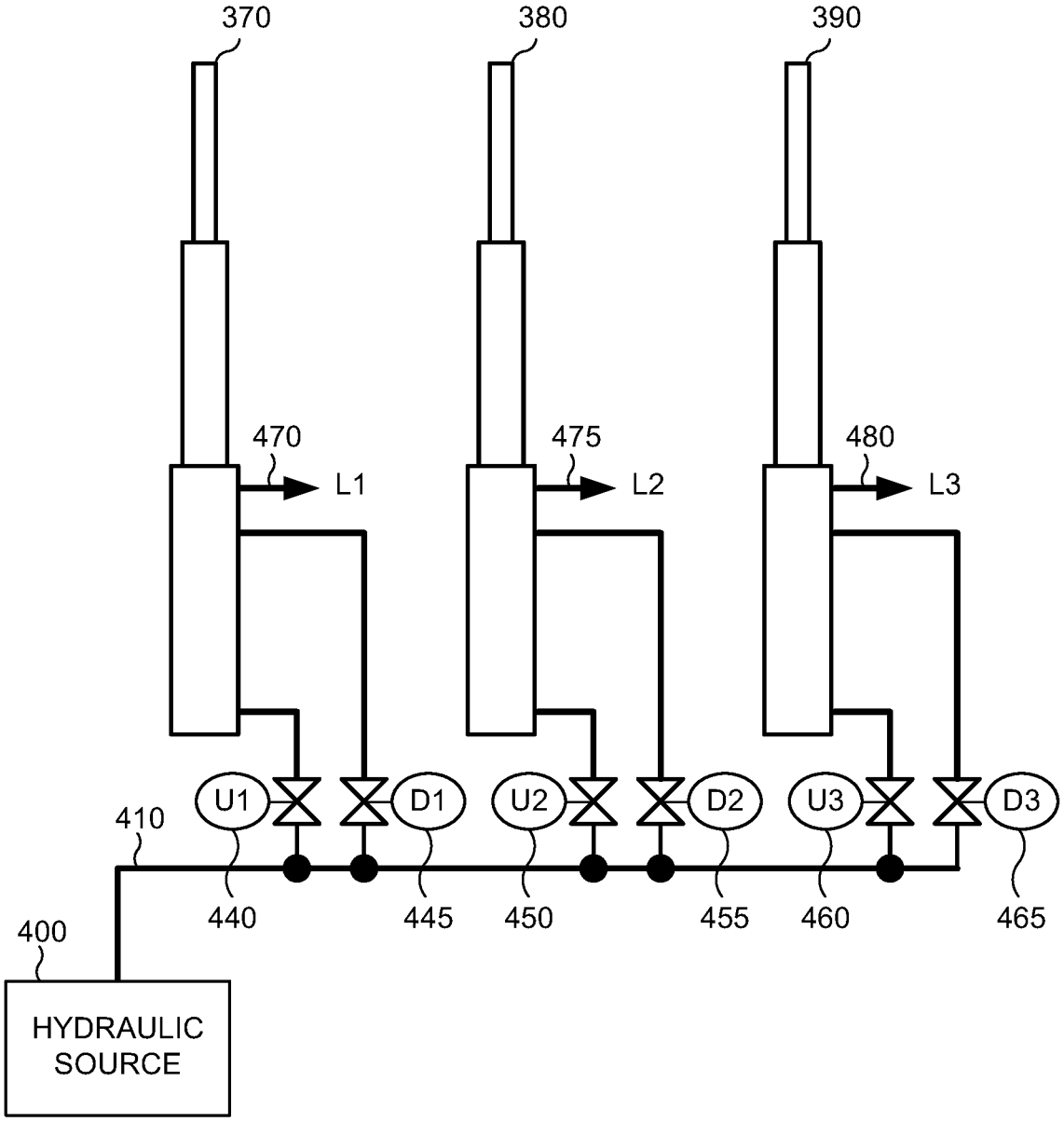
FIG. 11 is a pictorial diagram that depicts a control structure for a Delta-P lifting unit.

FIG. 11 is a pictorial diagram that depicts a control structure for a Delta-P lifting unit 300. For the sake of clarity, it is helpful to visualize that the cap members held together by cap spans can be referred to as a cap or capping structure. It should be appreciated that, according to one alternative example embodiment, extendable risers, which are depicted here by reference numerals 370 and 380, comprise dual acting pressurized cylinders. In an alternative example embodiment, a lifting unit also includes a third extendable riser 390. In any such alternative embodiment, each extendable riser provides a load signal, which indicates the amount of force applied to that particular extendable riser. For example, one embodiment includes two extendable risers 370, 380 each of which generates an independent load signal 470, 475. In embodiments that include a third extendable riser 380, that extendable riser provides a third independent load signal 480.

Each extendable riser, according to one alternative example embodiment, is provided with at least one control valve, which is used to increase the length of a corresponding extendable riser. For example, in one alternative embodiment, a first valve 440 and a second valve 450 are included in a lifting system and are used to extend the length of a first extendable riser 370 and a second extendable riser 380. It should be appreciated that, when any such valve is actuated, pressurized working fluid, which is obtained from a hydraulic source 400, is directed to a first port in a corresponding extendable riser.

When the working fluid enters the first port included in the extendable riser, that riser will extend in length. As the riser extends in length, it applies an increasing force to the cap structure according to the pressure of the working fluid applied when a corresponding valve is actuated. Again, for the sake of clarity, an increasing force upon the cap structure causes the cap structure to move upward relative to a tank floor. As such, these valves are indicated as "UP" valves ("U"). It should also be appreciated that, in those embodiments that include a third extendable riser, a third such "U" valve 460 is provided. When the third "U" valve is actuated, pressurized working fluid from the hydraulic source 400 is directed to the first port in the third cylinder 380. This causes the extension of the third extendable riser 390.

FIG. 11 further illustrates that, at least according to some alternative example embodiments, the extendable risers comprises dual acting risers. In such embodiments, additional valves are provided for a downward movement ("D") of the extendable vertical risers. Accordingly, in embodiments of a lifting system that include two extendable vertical risers 370, 380 a first down valve 445 and a second down valve 455 enable application of a pressurized fluid to a second port included in each such extendable riser. When the pressurized working fluid enters the second port included in the extendable riser, it causes the length of the extendable riser to be reduced. This reduces the force pushing upward on the cap structure included in a Delta-P lifting unit, which causes the cap structure to move downward. The same is true for those embodiments that include a third extendable riser 390 and a third corresponding "D" valve 465.

Figure 12B:
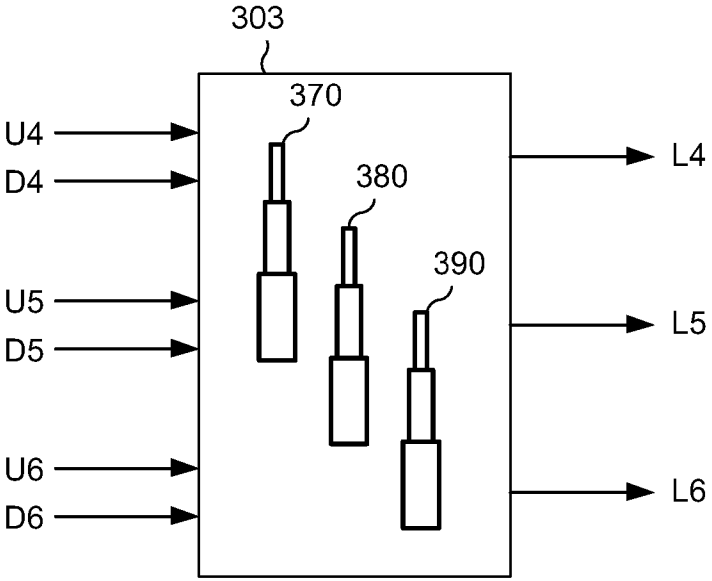
FIGS. 12A and 12B are pictorial diagrams that illustrate a control structure for raising a floating roof in more than one section.
Figure 12A:
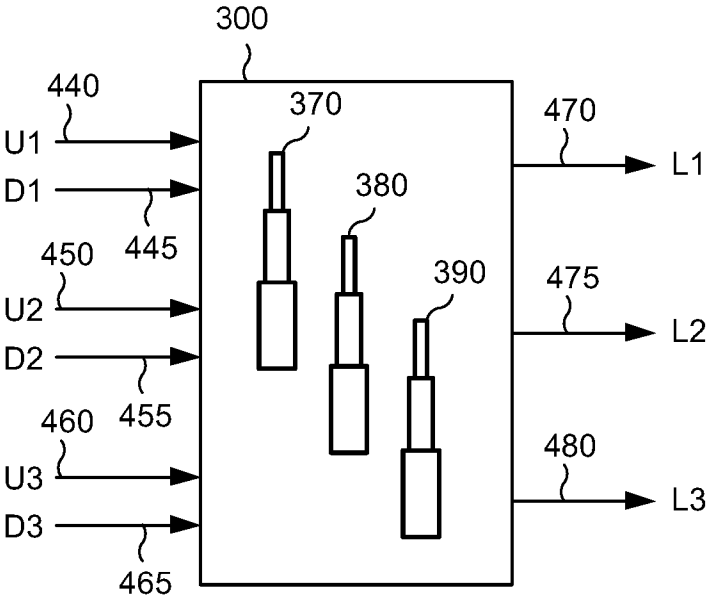

FIGS. 12A and 12B are pictorial diagrams that illustrate a control structure for raising a floating roof in more than one section. It should be appreciated that, as heretofore discussed, raising a floating roof, according to one illustrated use case, must be done by raising a floating roof according to sections. It should be appreciated that in such alternative example methods, it is necessary to utilize a first set of forces, which are applied to a first section of the roof and a second set of forces which are applied to a second section of the roof. Accordingly, a first Delta-P lifting unit 300 is disposed underneath the floating roof at a first section (122 in FIG. 7) and a second Delta P lifting unit 303 is disposed under the floating roof at a second section (123 in FIG. 7).

It should be appreciated that, according to one alternative example embodiment, a Delta-P lifting unit includes an interface for receiving control signals that actuate valves in order to raise or lower a cap structure included in the Delta-P lifting unit. In this alternative example embodiment, the Delta-P lifting unit 300 includes an interface for raising or lowering any of three different extendable risers 370, 380, 390, which are included in the Delta-P lifting unit 300. A second Delta-P lifting unit 303 also includes such interfaces for its three separate extendable risers. According to this example embodiment, the interfaces for controlling valves in a Delta-P lifting unit 300 includes a first "UP" valve interface 440, a first "DOWN" valve interface 445, a second "UP" valve interface 450, a second "DOWN" valve interface 455, a third "UP" valve interface 460 and a third "DOWN" valve interface 465. It should be appreciated that a Delta-P lifting unit is essentially a fungible item and a second Delta-P lifting unit 303 includes like interfaces to those included in the first Delta-P lifting unit 300.

Figure 13:
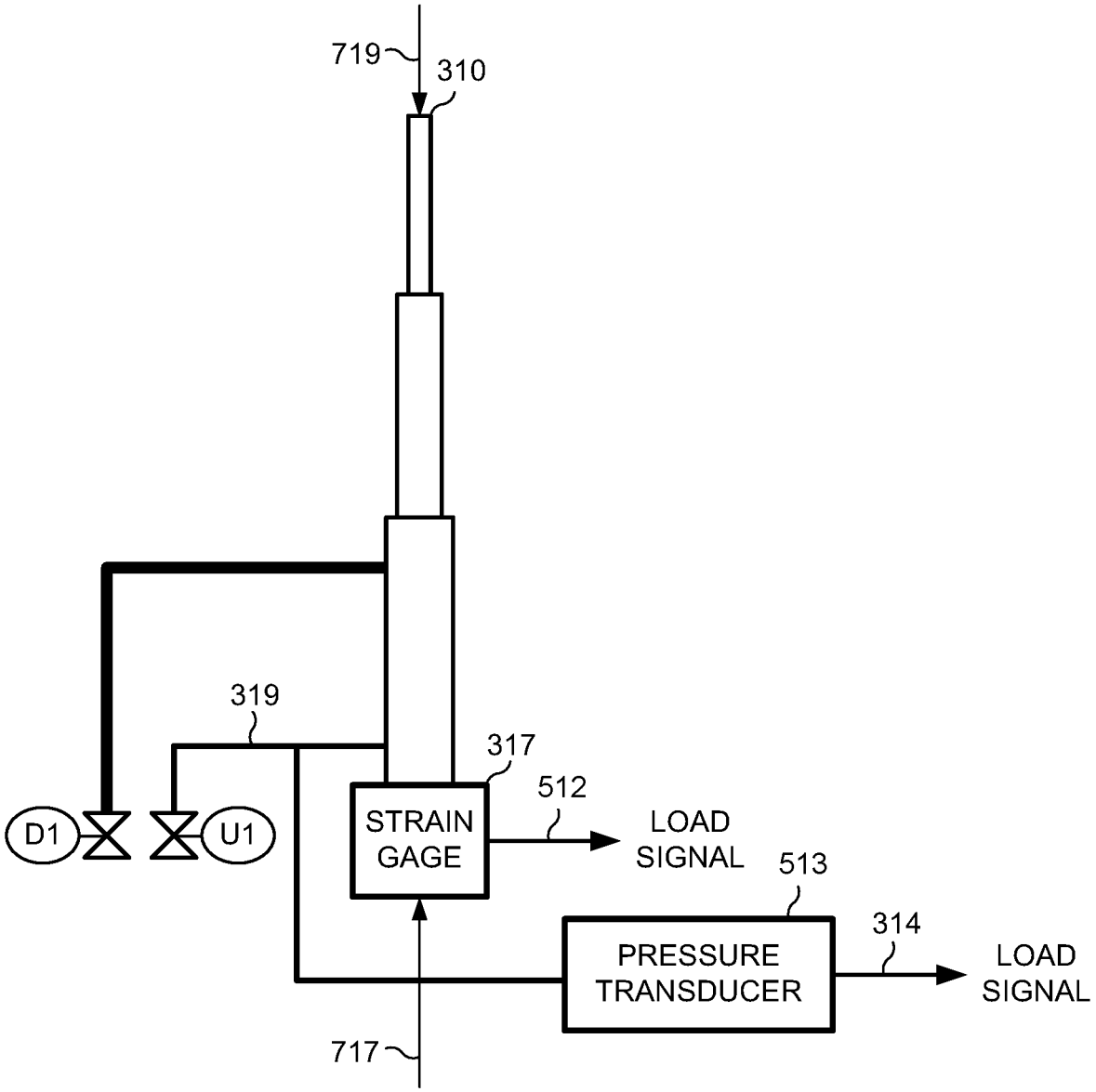
FIG. 13 is a pictorial diagram that depicts a hydraulic control structure for a Delta-P lifting unit.

FIG. 13 is a pictorial diagram that depicts a hydraulic control structure for a Delta-P lifting unit. It should be appreciated that each extendable riser 310 in a Delta-P lifting unit 300 is subject to at least two forces. One such force is a downward force 719 imparted upon the extendable riser as result of the weight of a floating roof applied upon the Delta-P lifting unit 300. A substantially equal but opposite force is directed upward 717 against the extendable riser 310 and can be in opposition to the downward force 719.

Notwithstanding the fact that the downward force 719 is imparted upon the extendable riser 310 by other mechanical members included in a Delta-P lifting unit 300, for example a cap structure as heretofore described, forces imparted longitudinally upon the extendable riser 310 are, according to one alternative example embodiment, measured in at least one of two ways. In a first alternative embodiment, the force upon the extendable riser 310 is determined, or more properly measured by a strain gage 317 that is disposed upon the extendable riser 310 in order to measure the forces applied longitudinally thereupon.

In yet a second alternative embodiment, the force imparted to the extendable riser 310 is determined by inference. For example, in this alternative embodiment, the pressure of a working fluid 319 applied to the extendable riser 310 is measured by a pressure transducer 513. In either of these alternative example embodiments, a load signal is created in accordance with the forces applied to the extendable riser 310. In the case where a strain gage 317 is disposed on the extendable riser 310, the strain gage 317 generates a load signal 512. Likewise, in those alternative embodiments that include a pressure transducer 513, the pressure transducer 513 also generates a load signal 314.

Figure 14:
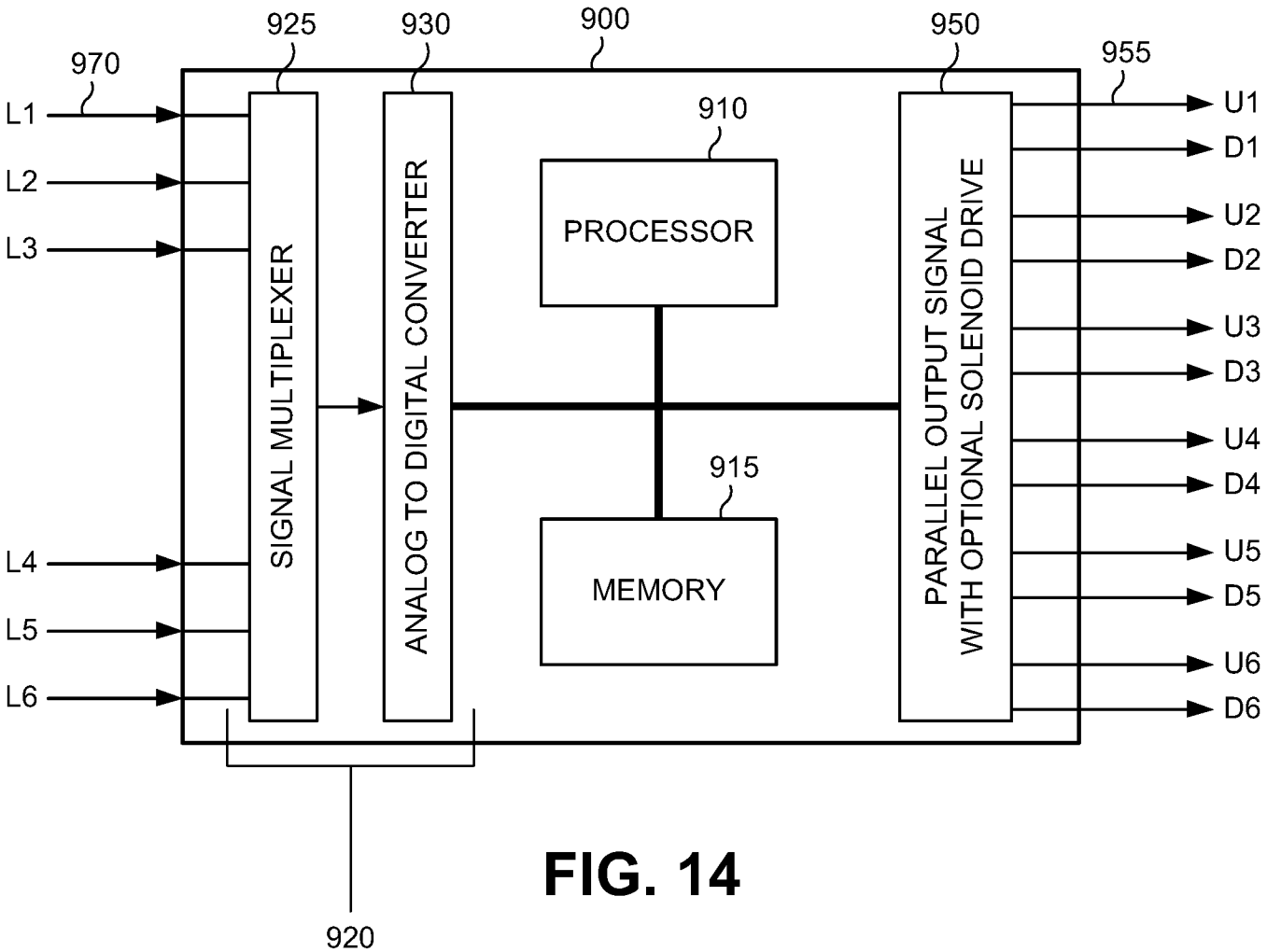
FIG. 14 is a pictorial diagram that depicts an alternative example of a control panel for use with Delta-P lifting units.

FIG. 14 is a pictorial diagrams that depicts one alternative example embodiment of a control panel for use with the Delta-P lifting units in accordance with teachings of the present method. It should be appreciated that the hydraulic valves described above need to be controlled in order to safely and effectively raise a roof using the teachings set forth herein. In one alternative example embodiment, a control panel 900 includes a processor 910 and a memory 915. In this alternative example embodiment, the control panel 900 further includes a force acquisition system 920.

In yet another alternative example embodiment, the force acquisition system 920 comprises a signal multiplexer 925 and an analog digital converter 930. Again, this is just one alternative example embodiment of a force acquisition system 920. In other alternative example embodiments, the force acquisition system is a digital interface that receives force indications from force transducers that transmit force indications in digital form. In this alternative embodiment, a valve control system 950 is also included. A plurality of valve control outputs 955 are included in this alternative example embodiment. It should be appreciated that, according to one alternative embodiment, valve control outputs 955 are organized in pairs in order to control the upward valve ("UP") and a downward valve ("DOWN"). It should also be further appreciated that three such pairs are needed to control each Delta-P lifting unit 300 used to raise a floating roof according to the techniques and teachings presented herein.

In various alternative example embodiments, the processor 910 executes included instruction sequences that are stored in a memory 915. These instruction sequences, when executed by the processor 910, minimally cause the processor 910 to retrieve a force indicator from one of three force acquisition interfaces 970 included in the force acquisition unit 920. The force acquisition interfaces 970 are typically organized in a grouping of three such interfaces, wherein each interface grouping receives a force indicator, for example by way of a load signal, from each of three extendable risers included in a Delta-P lifting unit 300. The instruction sequences, once further executed by the processor 910, minimally cause the processor 910 to adjust the forces experienced by each of the extendable risers in a Delta-P lifting unit 300 in accordance with the methods taught herein. In order to affect adjustment of the forces experienced by each of the extendable risers 310, the instruction sequences further minimally cause the processor 910 to actuate the upward and downward valves for each such extendable risers.

It should be further appreciated that there are several further techniques described herein wherein the processor 910 as it executes instruction sequences stored in a memory 915 is further minimally caused to control three sets of control valves, wherein each set of three control valves control extendable risers 310 in an individual Delta-P lifting unit. Accordingly, the processor 910 controls these valves in response to force signals from individual Delta-P lifting units 300 where the individual Delta-P lifting units are disposed underneath a floating roof in different sections of said roof.

Accordingly, in these situations, the processor 910 not only seeks to normalize the forces experienced by each of the three extendable risers in a particular Delta-P lifting unit, but is also further minimally caused to maintain the forces experienced by the extendable risers in a first Delta-P lifting unit 300 and the forces experienced by the extendable risers in a second Delta-P lifting unit 303 so as to ensure that the forces experienced by extendable risers in the first Delta-P lifting unit 300 are within some pre-established difference from the forces experienced by the extendable risers in the second Delta-P lifting unit 303. This is consistent with the teachings presented herein. It should further be appreciated that processor based control systems are well-known. However, the fact that processor based control systems are well-known is not intended to limit the scope of the claims appended hereto and a processor based control system that implements the methods and techniques for raising a floating roof as herein described is not heretofore known, either generally or in the field of raising floating roofs.

While the present method and apparatus has been described in terms of several alternative and exemplary embodiments, it is contemplated that alternatives, modifications, permutations, and equivalents thereof will become apparent to those skilled in the art upon a reading of the specification and study of the drawings. It is therefore intended that the true spirit and scope of the claims appended hereto include all such alternatives, modifications, permutations, and equivalents.

What is claimed is:

1. A lifting system for raising a floating roof in a tank, the lifting system comprising:

a first base member and a second base member, the first base member and the second base member each comprising:
a riser coupler; and
a span coupler;

a first cap member and a second cap member, the first cap member and the second cap member each comprising:
a riser coupler; and
a span coupler;

a base span configured to be coupled to and extend between the span coupler of the first base member and the span coupler of the second base member;

a cap span configured to be coupled to and extend between the span coupler of the first cap member and the span coupler of the second cap member;

a first extendable riser configured to be coupled to and extend between the riser coupler of the first base member and the riser coupler of the first cap member; and a second extendable riser configured to be coupled to and extend between the riser coupler of the second base member and the riser coupler of the second cap member;

wherein the first extendable riser and the second extendable riser each include a pressurized cylinder.

2. The lifting system of claim 1 wherein each of the pressurized cylinders comprises a hydraulic cylinder.

3. The lifting system of claim 1 wherein each of the pressurized cylinders comprises a dual-acting hydraulic cylinder.

4. The lifting system of claim 1 wherein the span couplers of the first base member, the second base member, the first cap member, and the second cap member are first span couplers;

wherein the base span is a first base span and the cap span is a first cap span; and wherein the first base member, the second base member, the first cap member, and the second cap member each include a second span coupler;

the lifting system comprising:

a third base member comprising:

a riser coupler;

a first span coupler; and a second span coupler;

a third cap member comprising:

a riser coupler;

a first span coupler; and a second span coupler;

a second base span configured to be coupled to and extend between the first span coupler of the third base member and the second span coupler of the first base member;

a third base span configured to be coupled to and extend between the second span coupler of the third base member and the second span coupler of the second base member;

a second cap span configured to be coupled to and extend between the first span coupler of the third cap member and the second span coupler of the first cap member;

a third cap span configured to be coupled to and extend between the second span coupler of the third cap member and the second span coupler of the second cap member; and a third extendable riser configured to be coupled to and extend between the riser coupler of the third base member and the riser coupler of the third cap member.

5. The lifting system of claim 4 further comprising:

a first force detector configured to measure compression force on the first extendable riser;

a second force detector configured to measure compression force on the second extendable riser; and a third force detector configured to measure compression force on the third extendable riser.

6. The lifting system of claim 5 wherein the first extendable riser, the second extendable riser, and the third extendable riser each comprise a strain gage.

7. The lifting system of claim 5 wherein and the third extendable riser comprises a pressurized cylinder, and wherein the first force detector, the second force detector, and the third force detector each comprise a pressure transducer configured to detect a pressure of a working fluid used to actuate each respective extendable riser.

8. The lifting system of claim 5 wherein the third extendable riser comprises a pressurized cylinder and wherein the first extendable riser, the second extendable riser, and the third extendable riser each comprise a first valve configured to be actuated to extend the extendable, riser and a second valve configured to be actuated to retract the extendable riser.

9. The lifting system of claim 5 wherein the first force detector, the second force detector, and the third force detector each generate a load-signal, the lifting system comprising:

a force management unit configured to receive the load-signals and generate force-control signals to minimize a difference in load on the first extendable riser, the second extendable riser, and/or the third extendable riser as indicated by the load-signals.

10. The lifting system of claim 9 wherein the force management unit comprises controller including:

a processor;

memory in which is stored at least one of a control program; and a force indicator;

a force acquisition unit configured to receive force indications from the load-signals; and a force control interface configured to direct a control signal to a valve associated with one of the first extendable riser, the second extendable riser, or the third extendable riser.

11. The lifting system of claim 4 wherein the first extendable riser, the second extendable riser, and the third extendable riser are positioned at the points of a triangle when viewed from a plan perspective.

12. A lifting system for raising a floating roof in a tank, the lifting system comprising:

a first vertical support member including a base, a cap, and a pressurized cylinder;

a second vertical support member including a base, a cap, and a pressurized cylinder;

a base span extending between the base of the first vertical support member and the base of the second vertical support member; and a cap span extending between the cap of the first vertical support member and the cap of the second vertical support member;

wherein the first vertical support member and the second vertical support member are extendable.

13. The lifting system of claim 12 positioned in the tank and supporting the floating roof.

14. The lifting system of claim 12 wherein each of the pressurized cylinders comprises a hydraulic cylinder.

15. The lifting system of claim 12 comprising a controller configured to maintain a compression force on each of the first vertical support member and the second vertical support member within a pre-established difference.

16. The lifting system of claim 12 wherein the base span is a first base span and the cap span is a first cap span, the lifting system comprising:

a third vertical support member including a base and a cap;

a second base span extending between the base of the third vertical support member and the base of the first vertical support member;

a third base span extending between the base of the third vertical support member and the base of the second vertical support member;

a second cap span extending between the cap of the third vertical support member and the cap of the first vertical support member; and a third cap span extending between the cap of the third vertical support member and the cap of the second vertical support member;

wherein the third vertical support member is extendable.

17. The lifting system of claim 16 wherein the first vertical support member, the second vertical support member, and the third vertical support member are positioned at the points of a triangle when viewed from a plan perspective.

18. The lifting system of claim 12 positioned in the tank and supporting the floating roof.

19. At least three of the lifting systems of claim 12 positioned in the tank and supporting the floating roof.

20. A method comprising raising the floating roof of the tank with the lifting system of claim 12.

* * * * *